United States Patent [19]

Eyzaguirre et al.

[11] Patent Number: 5,056,502

[45] Date of Patent: Oct. 15, 1991

[54] FRICTION HEAT GENERATOR

[76] Inventors: Ramon C. Eyzaguirre, 1494 SW. 32nd Ct., Fort Lauderdale, Fla. 33315; Patrick S. Thomas, 862 SW. 118th Ter., Davie, Fla. 33325

[21] Appl. No.: 666,627

[22] Filed: Mar. 8, 1991

[51] Int. Cl.[5] ..... F24C 9/00

[52] U.S. Cl. ..... 126/247; 122/26

[58] Field of Search ..... 126/247; 122/26; 237/1 R

[56] References Cited

U.S. PATENT DOCUMENTS

| | | | |
|---|---|---|---|
| 2,090,873 | 8/1937 | Lazarus | 122/26 |
| 3,402,702 | 9/1968 | Love | 122/26 |
| 4,285,329 | 8/1981 | Moline | 126/247 |
| 4,295,461 | 10/1981 | Cummings et al. | 126/247 |
| 4,462,386 | 7/1984 | Powell | 126/247 |
| 4,501,231 | 2/1985 | Perkins | 122/26 |
| 4,524,755 | 6/1985 | Harris et al. | 126/247 |
| 4,664,068 | 5/1987 | Kretchmar et al. | 122/26 |

OTHER PUBLICATIONS

SAE Aerospace Material Specification AMS 7879A, 11-1-70, Tungsten Carbide-Cobalt Powder for Plasma Coat.

SAE Aerospace Material Specification AMS 5536K, (no date), Corrosion and Heat Resistant Alloy Sheet Strip and Plate.

*Primary Examiner*—Edward G. Favors

*Attorney, Agent, or Firm*—Alvin S. Blum; Alvin S. Blum

[57] ABSTRACT

A device for heating air includes at least one rotatable disc pressed against at least one stationary disc and rotatably driven by a drive motor having variable speed. The friction between the discs generates heat that is taken up by a circulating fluid. A fan generates a current of air that takes up the heat from the fluid in a heat exchanger. A proportioning temperature regulated speed control senses the difference between a preset temperature and the air temperature and regulates the speed of the drive motor proportionally so that the greater the difference the faster the disc rotates and the more frictional heat is generated. The discs are made of special metal in thin section for enhanced heat transfer and reduced weight. The metal has high tensile strength at high temperature and special abrasion and temperature resistant coating for reduced wear and maintenance.

20 Claims, 1 Drawing Sheet

FRICTION HEAT GENERATOR

BACKGROUND OF THE INVENTION

Electrically powered space heaters that blow hot air out into a space to be heated are well known in the art. Many employ an electrically resistive element that is heated by an electric current. Air forced over the hot element is heated. The very hot element may be a safety hazard. Heaters that generate heat by friction of rotating discs rubbing against stationary discs are exemplified by U.S. Pat. No. 4,295,461 issued Oct. 20, 1981 to Cummings et al. Problems encountered with such devices include efficient heat transfer from the hot discs to a circulating heat transfer fluid as disclosed in U.S. Pat. No. 3,402,702 issued Sept. 24, 1968 to Love and wear of frictional surfaces as disclosed in U.S. Pat. No. 4,524,755 issued Jun. 25, 1985 to Harris et al and also U.S. Pat. No. 2,090,873 issued Aug. 24, 1937 to Lazarus in which it is disclosed that lignum vitae rubbing against cast iron has suitable wear resistant properties. Unfortunately using lignum vitae and cast iron for their wear resistant properties complicates heat transfer problems because these materials have a poor thermal conductivity and must be made thick because they are weak in thin section. And blocks of material that move up to replace worn away surface are also excessively thick for efficient heat transfer.

SUMMARY OF THE INVENTION

It is accordingly an object of the invention to provide a compact, light-weight and efficient space heater of the friction disc type in which efficient heat transfer from the discs is combined with unique physical properties of the discs that reduce wear of the frictional surfaces to overcome the need for wear compensation in the structure.

The frictional heat generator of the invention includes: a friction generating chamber containing a driven shaft and a heat transfer liquid; at least one rotary disc keyed to rotate with the shaft; pump means for circulating the liquid; at least one stationary disc frictionally engaging the rotary disc; a heat exchanger for transferring heat from the heat transfer liquid to a second fluid, generally air, together with a means of moving the second fluid, generally an air fan or blower. The rotary and stationary discs are formed with a thin section for efficient heat transfer to the heat transfer liquid. The discs are of a special metal that combines high strength at elevated temperatures with special surface properties that resist wear from the constant frictional action even at elevated temperatures.

These and other objects, advantages and features of the invention will become more apparent when the detailed description is studied in conjunction with the drawings.

DETAILED DESCRIPTION OF THE PREFERRED EMBODIMENT

Figure 1:
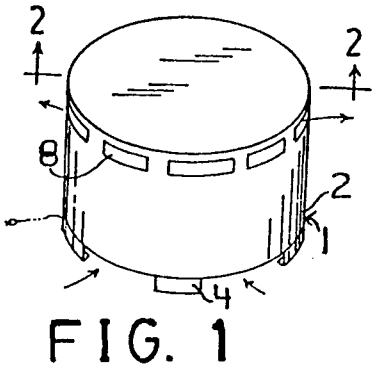
FIG. 1 is a perspective view of the invention.
Figure 2:
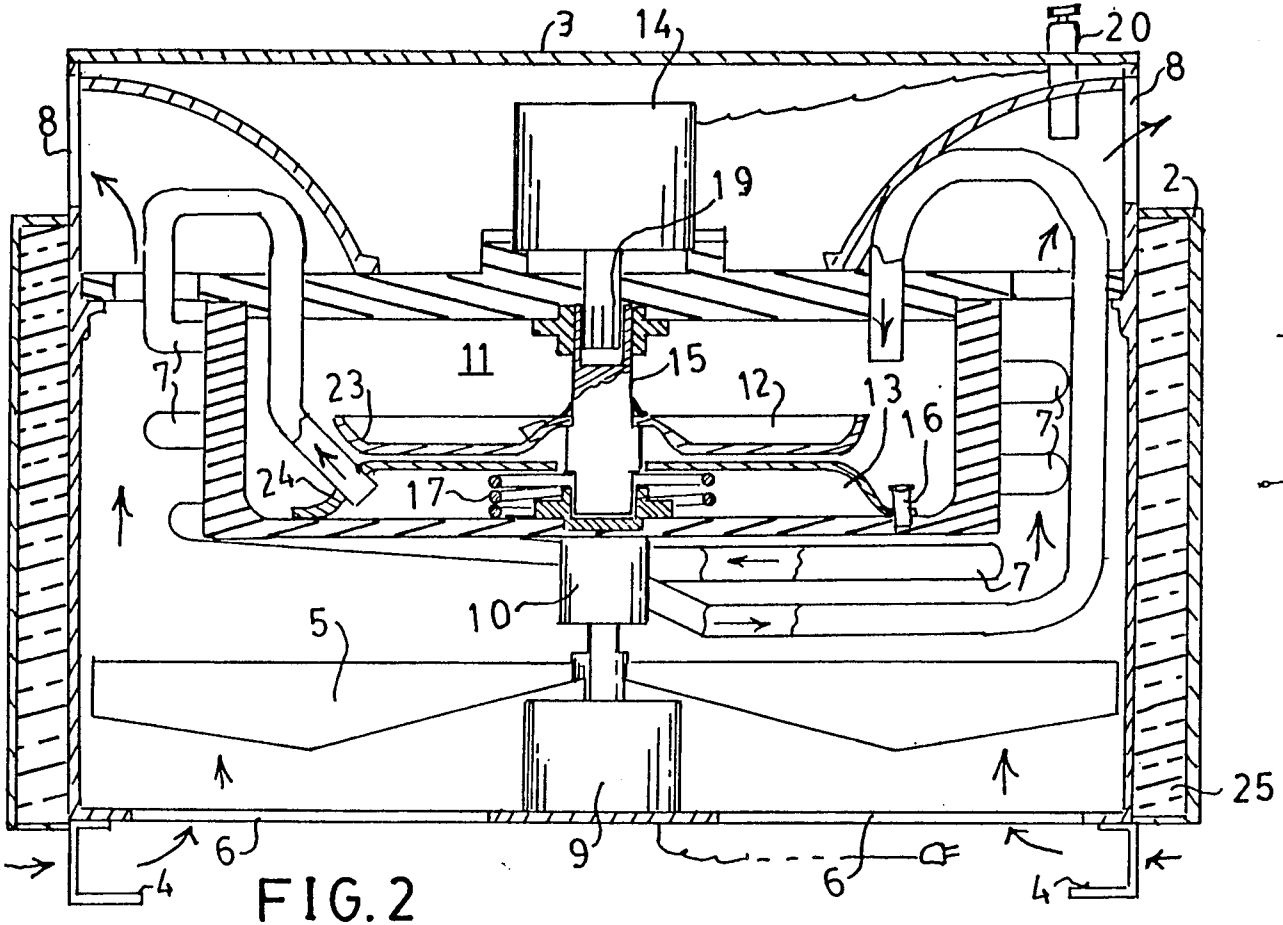
FIG. 2 is a vertical sectional view of the invention taken on line 2—2 of FIG. 1.

Referring now to the drawings, the compact friction heater 1 of the invention comprises a cylindrical shell 2 with a flat top 3 resting on legs 4 that provide an underneath entrance for cold air that is drawn by fan 5 through entrance ports 6, past heat exchanger coils 7 where the air is warmed and out through exit ports 8. A motor 9 drives fan 5 and a fluid pump 10. The pump 10 pumps a heat exchange fluid through the coils 7 and through the central chamber 11 in which the fluid is heated by the friction action of rotary disc 12 rubbing against stationary disc 13. A variable speed electric drive motor 14 drives driveshaft 15. Rotary disc 12 is keyed to driveshaft 15 so that the disc 12 rotates at the speed of the motor. The stationary disc 13 is held by a plurality of guide pins 16 that prevent its rotation but permit free vertical motion. Helical compression spring 17 forces the stationary disc 13 up against the rotary disc 12 with controlled spring bias to regulate the frictional forces between the two discs. Struck out from the rotary disc 12 are a plurality of tabs or vanes 18 that are inclined in a direction opposite to the direction of rotation. When rotating, these vanes thrust against the fluid and a resultant downward force vector forces the rotary disc downward against the stationary disc so that there is greater friction during rotation than at rest. This mechanism reduces the starting load on the drive motor. The driveshaft 15 is splined to the drive motor 14 by splines 19 to provide for limited axial movement of the rotary disc.

A temperature control 20 senses the temperature of the heated air leaving the generator and controls the speed of drive motor 14 according to the difference between the set temperature and the sensed temperature. The greater the difference between the temperatures, the greater the speed of the motor. This proportioning control of heat output is superior to the on/off control of these devices of the prior art. It provides for less variation in output air temperature and reduces the number of starts that are so stressful to the equipment.

The particular structure of the discs 12 and 13 is especially adapted for most effective use in this application. They have flat meeting faces 21, 22 for effective frictional contact and curved or domed perimeters 23, 24 to maintain rigidity despite a very thin cross section. The thin cross section reduces weight, and starting inertia. Furthermore, the thin discs enhance heat transfer from the rubbing surfaces, through the disc to the moving heat transfer fluid. A very thin disc may be easily broken or worn away by the continuous rubbing.

The discs are made of special material to overcome these limitations.

The discs are made of an alloy meeting aerospace material specification (AMS) 5536. This is a nickel based alloy of high tensile strength with heat and corrosion resistant properties. A hard face coating of a fine grain tungsten carbide-cobalt powder is bonded by plasma coating to the rubbing surface at 2050° F. to provide a microhardness of Rockwell C-58. The abrasive wear resistance properties of the plasma hard coating permit long periods of operation without need for disc maintenance or replacement. This coating meets aerospace material specification AMS 7879.

Alternatively, the discs may be made of other high strength metals such as aluminum alloy and coated with other abrasion resistant coating material.

Insulation 25 may be provided to keep the outer surface at safe temperatures.

For greater output, the diameter of the discs may be increased or a plurality of rotary and stationary discs may be interleaved.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

We claim:

1. A friction heat generating device comprising:

a) a chamber having two end plates and containing a heat transfer fluid;

b) a drive shaft journaled in said end plates for rotation within said chamber;

c) a drive motor attached to one of said end plates and operably connected by connecting means to said drive shaft for rotation thereof, said drive motor being of the variable speed type;

d) a heat exchanger means in fluid connection with said chamber;

e) fluid pump means for circulating said fluid through said heat exchanger means and said chamber;

f) air blower means for forcing a current of ambient air through said heat exchanger means to transfer heat from said fluid to said current of air;

g) at least one rotatable disc connected to said drive shaft for rotation therewith;

h) at least one stationary disc, mounted on one of said end plates by mounting means, for frictional contact with one rotatable disc; and i) proportioning control means connected to said drive motor and arranged to sense a first temperature at a particular location and having means for setting a desired temperature, said control means regulating the speed of said drive motor in proportion to the difference between the first temperature and the desired temperature.

2. The device according to claim 1, in which said rotatable and stationary discs are made of a thin, thermally conductive metal having high tensile strength at high temperatures and coated with abrasion resistant coating on the frictional surfaces thereof.

3. The device according to claim 2, in which: said metal is an alloy of nickel, chromium, cobalt, molybdenum, tungsten and iron; and said coating is a tungsten carbide-cobalt powder coated by plasma spray coating.

4. The device according to claim 3, in which said metal meets aerospace material specification number AMS 5536, of the Society of Automotive Engineers Inc.

5. The device according to claim 4, in which said coating meets the aerospace material specification number AMS 7879 of the Society of Automotive Engineers Inc.

6. The device according to claim 3, in which said coating meets the aerospace material specification number AMS 7879 of the Society of Automotive Engineers Inc.

7. The device according to claim 2, in which said metal has a tensile strength of at least 90,000 PSI and a yield strength at 2% offset of at least 35,000 PSI in thickness less than 1 inch and shall have the following stress-rupture properties: a tensile specimen, maintained at 1500° F. while a load sufficient to produce an axial stress of 16,000 PSI is applied continuously, shall not rupture in less than 12 hours, and elongation after rupture shall be not less than 6% in 4D for thickness over 0.002 inches.

8. The device according to claim 2, in which said coating has: a porosity of less than 1%; a coating macrohardness equivalent to at least Rockwell C58; a bond strength of at least 8,000 PSI; and a melting point not less than 1500° F.

9. The device according to claim 1, in which said rotatable disc includes at least one tab struck out of said disc and directed away from said stationary disc at an angle inclined away from the direction of rotation of said rotatable disc, whereby rotation of said disc forces said tab against said fluid and provides a reaction force vector pressing said rotatable disc against said stationary disc to provide greater friction upon rotation than at rest.

10. The device according to claim 9, in which said connecting means provides axial movement of said shaft and rotatable disc to enhance the pressing action of said tab.

11. A friction heat generating device comprising:

a) a chamber having two end plates and containing a heat transfer fluid;

b) a drive shaft journaled in said end plates for rotation within said chamber;

c) a drive motor attached to one of said end plates and operably connected by connecting means to said drive shaft for rotation thereof;

d) a heat exchanger means in fluid connection with said chamber;

e) fluid pump means for circulating said fluid through said heat exchanger means and said chamber;

f) air blower means for forcing a current of ambient air through said heat exchanger means to transfer heat from said fluid to said current of air;

g) at least one rotatable disc connected to said drive shaft for rotation therewith;

h) at least one stationary disc, mounted on one of said end plates by mounting means, for frictional contact with one rotatable disc; and i) said rotatable and stationary discs being made of a thin, thermally conductive metal having high tensile strength at high temperatures and coated with abrasion resistant coating on the frictional surfaces thereof.

12. The device according to claim 11, in which: said metal is an alloy of nickel, chromium, cobalt, molybdenum, tungsten and iron; and said coating is a tungsten carbide-cobalt powder coated by plasma spray coating.

13. The device according to claim 12, in which said metal meets aerospace material specification number AMS 5536, of the Society of Automotive Engineers Inc.

14. The device according to claim 13, in which said coating meets the aerospace material specification number AMS 7879 of the Society of Automotive Engineers Inc.

15. The device according to claim 11, in which said coating meets the aerospace material specification number AMS 7879, of the Society of Automotive Engineers Inc.

16. The device according to claim 11, in which said metal has a tensile strength of at least 90,000 PSI and a yield strength at 2% offset of at least 35,000 PSI in thickness less than 1 inch and shall have the following stress-rupture properties: a tensile specimen, maintained at 1500° F. while a load sufficient to produce an axial stress of 16,000 PSI is applied continuously, shall not rupture in less than 12 hours, and elongation after rupture shall be not less than 6% in 4D for thickness over 0.002 inches.

17. The device according to claim 11, in which said coating has: a porosity of less than 1%; a coating macrohardness equivalent to at least Rockwell C58; a bond strength of at least 8,000 PSI; and a melting point not less than 1500° F.

18. The device according to claim 11, in which said rotatable disc includes at least one tab struck out of said disc and directed away from said stationary disc at an angle inclined away from the direction of rotation of said rotatable disc, whereby rotation of said disc forces said tab against said fluid and provides a reaction force vector pressing said rotatable disc against said stationary disc to provide greater friction upon rotation than at rest.

19. The device according to claim 18, in which said connecting means provides axial movement of said shaft and rotatable disc to enhance the pressing action of said tab.

20. The device according to claim 11, in which said mounting means provides axial movement of said stationary disc along said shaft and prevents rotation therewith, and further comprising spring bias means for urging said stationary disc toward said rotatable disc for frictional contact therewith.

* * * * *